US006350490B1

(12) United States Patent
Bressler et al.

(10) Patent No.: US 6,350,490 B1
(45) **Date of Patent: *Feb. 26, 2002**

(54) METHOD OF MANUFACTURING A ROTOGRAVURE PRINTING MEDIUM

(75) Inventors: David E. Bressler, Chester; W. Richard Chesnut, Essex Fells; Daniel Caligaro, Little Falls, all of NJ (US)

(73) Assignee: W. R. Chesnut Engineering, Inc., Fairfield, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/678,470

(22) Filed: Oct. 3, 2000

Related U.S. Application Data

(63) Continuation of application No. 07/692,211, filed on Apr. 26, 1991, now Pat. No. 6,136,375.

(51) Int. Cl.[7] ..... B05D 5/04

(52) U.S. Cl. ..... 427/277; 427/425; 118/321; 101/401.1; 430/307

(58) Field of Search ..... 427/277, 425; 118/321; 101/401.1; 430/307

(56) References Cited

U.S. PATENT DOCUMENTS 6,136,375 A * 10/2000 Bressler et al. ..... 427/277

* cited by examiner

*Primary Examiner*—Katherine A. Bareford
(74) *Attorney, Agent, or Firm*—Carella Byrne Bain Gilfillan Cecchi et al; John N. Bain; William Squire

(57) ABSTRACT

A rotogravure printing medium includes a member coated with a film that is selectively removable to produce ink retaining cells. The film is formed by a series of adjacent strip of bead portions of a self-leveling, curable plastic composition which is engravable after curing. The adjacent strip or bead portions merge and self-level after deposition to produce a uniform continuous coating of the plastic composition.

33 Claims, 3 Drawing Sheets

METHOD OF MANUFACTURING A ROTOGRAVURE PRINTING MEDIUM

This application is a continuation of application Ser. No. 07/692,211 filed Apr. 26, 1991, now U.S. Pat. No. 6,136, 375.

BACKGROUND OF THE INVENTION

This invention relates to a method of manufacturing a rotogravure printing medium and more particularly, to a method of applying a plastic printing medium to a printing roll or cylinder which is employed in rotogravure printing.

The present invention is related to commonly assigned U.S. patent application Ser. No. 514,595, filed Apr. 26, 1990, abandoned, and to commonly assigned, co-pending U.S. patent application Ser. No. 691,693 filed Apr. 24, 1991, abandoned, both of which are incorporated by reference hereinto. The subject matter of these applications later matured into U.S. Pat. No. 5,694,852 which is based on a continuation in part application of Ser. No. 08/525,880 filed Sep. 8, 1995, abandoned, which is a continuation in part of Ser. No. 991,499 filed Dec. 17, 1992, abandoned, which is a continuation of Ser. No. 691,693 noted above.

Rotogravure printing is a generally conventional method of printing on a sheet, web, or other substrate. The substrate may be a coated, uncoated, or metallized paper; glassine; plastic films and sheets made from vinyl, cellulose, acetate, polyester and polyethylene; plastic shrink films; paperboard; aluminum foil; fabrics; and similar materials. Rotogravure printing is capable of reproducing both subtle shades of color and black and white, and is particularly well suited for printing great numbers of copies precisely and rapidly. Typical end products for the printed substrates include labels, cartons, paper and plastic cups, trading stamps, wrapping paper, and sheet vinyl flooring.

Rotogravure printing is the only commercial printing process which can control both ink thickness and the area of ink coverage. This is achieved by etching or engraving recessed microscopic wells, frequently referred to as "cells," of varying depth and area in a printing medium or image carrier surface. In controlling the size and depth of the cells, the amount of ink available for placement on the substrate is controlled to generate an image composed of an arrangement of large and small dots. Other types of printing, such as flexographic printing, are generally similar to rotogravure printing, but are specifically different, e.g., as to thickness of the printing medium and the character and formation of ink-transferring surfaces.

In typical rotogravure printing, the printing medium or image carrier is a copper film electro-deposited from a chemical bath on a specially prepared steel cylinder. Prior to the engraving of the recessed wells, the copper is mechanically ground and polished. After engraving, the cylinder requires the addition of plated, hard chromium for durability and wear resistance. During the printing process the cylinder is rotated in a bath of ink. Excess ink is wiped away by a doctor blade and the ink remaining in the engraved cells is then transferred to a substrate as discrete dots, while the substrate passes between the engraved, inked cylinder and a soft pressure roller. Rotogravure printing using non-copper printing media is similarly effected.

The recommended modem process to prepare a copper image carrier requires the use of electrolytic deposition from an acid/copper bath. A steel cylinder of the required diameter is partly immersed in a chemical copper solution and rotated at a regulated speed. An electrical current running through the cylinder and the solution gradually deposits a coating of copper on the rotating cylinder until the approximate required thickness is achieved. The copper plated cylinder is washed and then polished to final dimensions with a smooth, mirror-like surface finish.

The copper coating is then engraved, either chemically or electronically. In the chemical engraving process, cells are formed by acid etching of the copper coating. The cells are formed by a screen which prevents the acid from reaching selected portions of the copper surface. The resulting acid-etched wells are round in shape and slightly smaller at the bottom than at the top.

The process of forming the copper coating for the printing cylinder and of chemically engraving the copper coating may result in the formation of waste products which are environmentally hazardous, requiring costly disposal. Further, the prior art techniques are costly and time-consuming.

An object of the present invention is a method of manufacturing a rotogravure printing medium which is inexpensive and expedient to produce and which avoids other shortcomings attending the use of copper (or other metallic) printing media.

SUMMARY OF THE INVENTION

In accordance with an aspect of the present invention, there is provided a method of manufacturing a printing medium for application to a printing apparatus (e.g., a rotogravure printing drum or cylinder). The terms "printing" and "rotogravure printing", as used herein, include any apparatus, device or method which involves the transfer of an inked image. The printing medium comprises a plastic composition which may be applied to a flat plate or a cylinder to form a plastic-coated printing plate, roll or cylinder, the plastic coating being etched, engraved or otherwise selectively removed to form the printing cells.

The plastic composition is any flowable, self-levelling, curable material capable of being deposited on a flat surface or on a printing cylinder or roll according to the method hereof to form a continuous coating, following curing of which, the composition may be etched, engraved or otherwise selectively removed to produce a printing surface. Preferred plastic compositions are those self-levelling, flowable materials set forth in the commonly assigned '595 and '693 applications.

The plastic composition may be applied to the printing substrate by various means well known in the art. The method of the present invention is particularly applicable to the application of the plastic composition in a flowable form to a printing roll or cylinder which is employed in a rotogravure printing process. The printing roll or cylinder may be made of a metal, such as aluminum, or steel, and may, contrary to the prior art, also be made of a non-metal, such as a plastic.

Prior to the application of the plastic composition to the printing roll or cylinder, the printing roll or cylinder may be pretreated by means of a plasma or corona pretreatment to clean and/or alter the surface (i.e., lower the surface tension) of the cylinder or roll for improved film or coating wetting and bonding strength.

When a corona pretreatment of the surface of the printing roll or cylinder is employed, the surface thereof may be treated with an accurately-directed electrical bombardment of the surface to clean and/or alter the surface of the printing roll or cylinder.

When an aluminum printing cylinder is employed, the surface may be pretreated so as to provide an anodized surface. When a steel cylinder is employed, the cylinder may be treated with an oxide such as black oxide.

Methods of applying the plastic composition include spraying the composition onto the surface of the printing substrate such as the printing roll or cylinder. Such spraying may be accomplished through the use of a nozzle through techniques known in the art. Other methods which may be employed include dip coating, spin coating, and ring coating. The coating, upon application by any method to the surface of the printing substrate intended for use in rotogravure printing, preferably has a thickness of from about 0.003" to about 0.015". Where the printing substrate is to be used for other types of printing, such as flexographic printing, thickness up to about 0.040" or more.

The preferred method of applying a selected plastic composition to the printing roll or cylinder is that described in detail below. Any of the compositions disclosed in the above-noted '693 application, as well as other curable, flowable, self-levelling plastic compositions may be applied to the printing roll or cylinder. Included are compositions in which printing images are "developed" following selective exposure to light or other radiation.

The selected plastic composition is applied to the printing cylinder by a delivery facility, such as a piston-cylinder, a metering pump or a precision gear pump from a defined site, such as a small orifice. If the composition comprises several materials, these may be mixed by static tube, mechanical or impingement techniques at or near the orifice. Preferably, the orifice is elliptical and is formed by angularly truncating a right circular cylindrical tube having a small circular cross-section bore to form a tip and a heel on the tube. The diameter of the bore, and the minor axis of the elliptical orifice, when viewed normally to the plane thereof, is about 0.010" to about 0.055", and is preferably about 0.030". The major axis of the elliptical orifice, when viewed normally to the plane thereof, is about 4 to 8 times larger than the minor axis, that is, about 0.040" to about 0.440", and is preferably about 0.120" to about 0.240".

The plastic composition is applied through the orifice as the orifice and surface are relatively moved. Where the surface is on a cylinder, is preferably rotated as the tube is linearly moved or scanned across the rotating surface thereof The plane of the elliptical orifice is tangentially proximate to the printing cylinder along the minor axis thereof (i.e., about midway between the tip and the heel), with the major axis extending along the direction of printing cylinder rotation. The plane of the orifice is preferably slightly upwardly tipped in the direction of movement of the tube. The plastic composition, when applied to the printing roll or cylinder, has a viscosity of from about 800 cP to about 5,000 cP, the viscosity preferably being from about 1,000 cP to about 2,000 cP. The plastic composition is applied at a pressure of from about 8 psi to about 60 psi, preferably at about 30 psi. The printing cylinder may be of a standard size, for example, it may have a diameter of about 361 mm, and is rotated at speeds of about 30 to about 90 rpm, with about 45 rpm being preferred. The tube and its orifice are moved along the rotating cylinder's surface at a rate of from about 0.008" per revolution to about 0.048" per revolution, with about 0.0192" per revolution being preferred.

If desired, multiple orifices may be used to deposit the plastic composition in several streams.

The orifice area, the viscosity of the plastic composition, the pressure at which the plastic composition is applied, the cylinder rotational speed, and the rate of movement of the tube and orifice across the cylinder surface are adjusted such that when the plastic composition is applied to the printing roll or cylinder, the thickness of the plastic composition deposited upon the cylinder is from about 0.003" to about 0.015", preferably from about 0.0032" to about 0.0035", and most preferably at about 0.0035". The plastic composition preferably is applied to the printing roll or cylinder at room temperature (about 23° C.), while the printing roll or cylinder, prior to application of the plastic composition, may be preheated to a temperature of from about 23° C. to about 40° C., preferably to about 30° C. It is preferred that the plastic composition be deposited to a desired thickness in a single pass of the tube and orifice across the surface of the rotating printing roll or cylinder.

In applying the plastic composition to the printing roll or cylinder as described above, there is formed a helical strip or bead of the plastic composition, the strip or bead having a circular and/or lobate cross-section as it is deposited on the printing roll or cylinder. Deposited portions of the helical strip or bead began to self-level, and adjacent, deposited portions of the strip or bead merge after being deposited to become a continuous coating of substantially uniform thickness and having the preferred average thickness on the printing roll or cylinder. Where the surface is planar, the adjacent portions of the strip or beed may be formed by indexing the tube or by the use of multiple orifices.

Following curing of the continuous coating, it is capable of being engraved, etched or otherwise selectively removed (as by photographic-like development or laser scribing) to provide a printing surface. Methods of curing include, but are not limited to, ultraviolet irradiation (which may be followed by heating), heating, and gelation at room temperature. The method employed to cure the composition depends upon the particular plastic composition applied to the printing substrate.

After the plastic coating is applied to the substrate and cured, it is engraved or etched so as to provide a printing medium or image carrier. The engraving may be accomplished by any of various engraving or etching methods known in the art; however, a preferred method of engraving is electronic engraving. Electronic engraving may, in one embodiment, be carried out using a diamond stylus which has an included angle of from about 110° to about 130°. The narrower the included angle, the deeper the stylus cuts into the plastic coating. As the stylus cuts into the coating, it forms a plurality of wells in the coating. Each well has an angled wall, and is smaller at the bottom than at the top.

The reliability of electronic engraving can be enhanced by employing an air knife device to aid in the removal of chips away from the support, or foot, of the diamond stylus. The air knife dispenses a precise, focused, and continuous or pulsed air stream. The air stream moves in a direction opposite that of the movement of the cylinder. The air stream directs chips away from the support, or foot, of the diamond stylus, the cutting diamond, and the burr cutter in a direction toward a vacuum device, whereby the chips may be removed from the printing surface by the vacuum device located in the cutting head.

Prior to engraving, the plastic coating may be contacted (preferably by spraying) with a finely divided fluropolymer as a dry film lubricant for the plastic coating. The dry film lubricant provides for lubrication of the support, or foot, of the diamond stylus as the stylus traverses the plastic coating during the engraving. Such lubrication provides for improved penetration of the surface of the plastic coating by the diamond stylus and provides for increased life of the diamond stylus. A preferred finely divided fluoropolymer powder is a micronized tetrafluoroethylene powder. An example of such a micronized tetrafluoroethylene powder is sold by DuPont, Wilmington, Del., as Vydax.

Once the printing medium or image carrier is formed on the substrate, it is ready for the application of printing ink. Examples of gravure type inks which may be applied to the printing medium include aliphatic hydrocarbon inks such as A-Type inks and B-Type inks; nitrocellouse inks (C-Type); polyamide inks (D-Type); alcohol-based inks (E-Type); polystyrene-based inks (M-Type); chlorinated rubber-based inks (T-Type); vinyl chloride or vinyl acetate copolymer-based inks (V-Type); inks employing water as a solvent base (W-Type); X-Type inks including heat transfer and sublimation inks; and foam inks. Preferred inks are those of the A, B, C, D and T Types. The type of ink employed depends upon the type of surface that is to be printed. Upon application of the ink, any excess ink is removed by a doctor blade. It has been found that a doctor blade formed from a polymer such as polyester, nylon, polyethylene, polypropylene, or polyacetal, and having a tapered edge which contacts the printing medium, conditions the image-bearing surface without substantial wear and is a great improvement over metal doctor blades employed in the art with copper-etched surfaces. Most preferably, a polyester doctor blade is employed for removing the excess ink. Examples of polyester doctor blades having a tapered edge which may be employed in accordance with the present invention are those of Esterlam's E350/E500 range of laminated polyester doctor blades, sold by Esterlam International Limited, of Devon, England.

DETAILED DESCRIPTION

Figure 1:
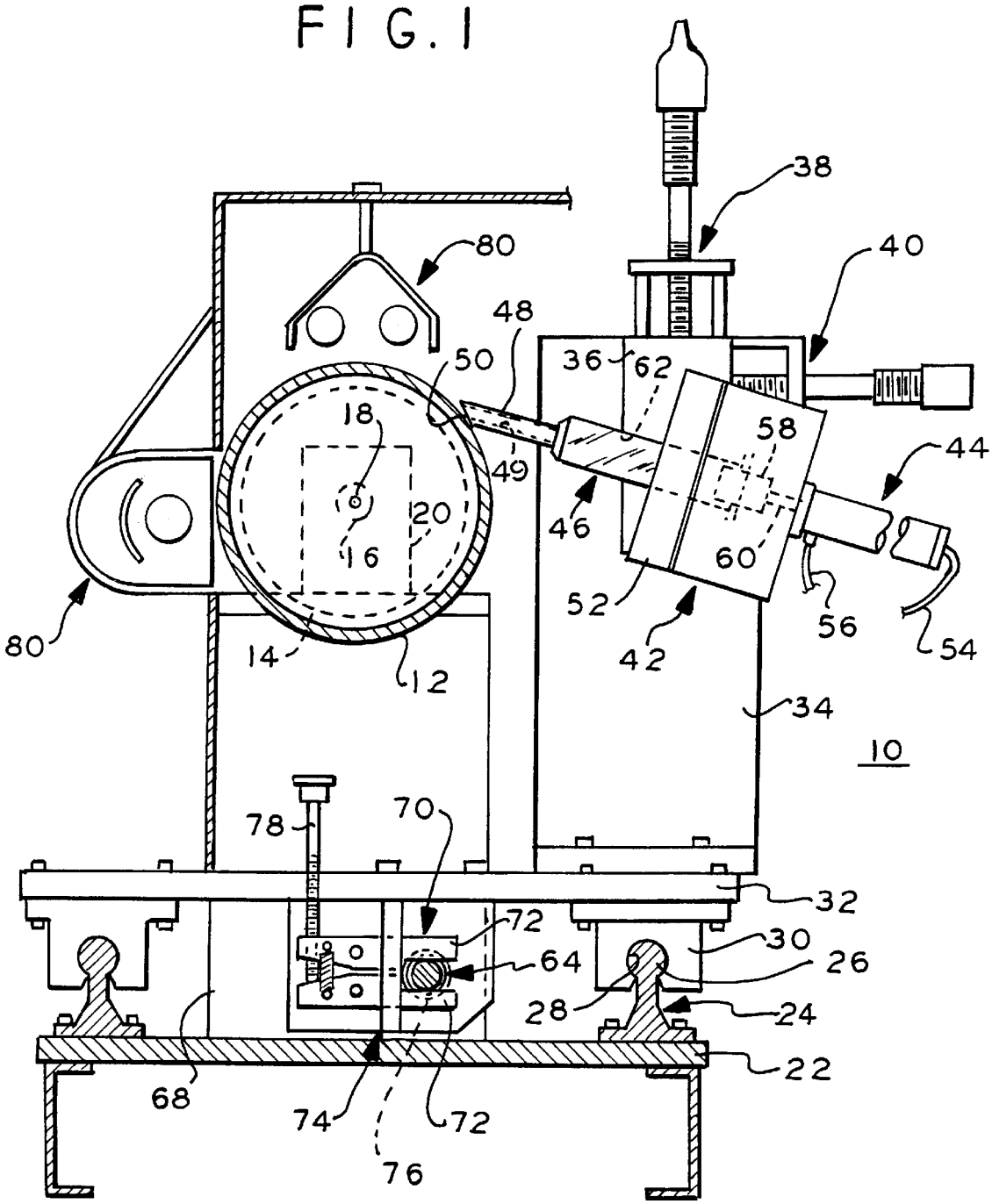
FIG. 1 is a partially sectioned, side elevation of apparatus for applying plastic compositions according to the method of the present invention.

Referring now to the Figures, there is shown one of a variety of apparatus 10 for carrying out the method hereof by applying a plastic coating as hereinabove described to a printing cylinder or roll 12 or other substrate. As noted, a planar surface, or a plate such as is common in flexographic printing, may be used. The cylinder 12 may be steel, aluminum or plastic and may be pretreated as hereinabove described. In one embodiment, the cylinder 12 has a diameter of about 361 mm.

The cylinder 12 is mounted on a holder, such as a mandrel, collet or chuck 14. The holder 14 and the cylinder 12 are selectively rotatable by a drive shaft 16 about the main axis 18 of the cylinder 12. The holder 14 may be rotatably supported at either end by standards 20, only one of which is shown. The standards 20 are fixed to a base or platform 22 which supports the apparatus 10.

The base 22 also supports opposed guide rails 24 having lobar support portions 26 keyed into mating ways 28 formed in supports 30. The supports 30 mount a carriage 32 which is horizontally slidable into and out of the plane of FIG. 1 along a fixed path above the base 22. The carriage 32 in turn mounts an upright support member 34 which extends above the mounted cylinder 12. The member 34 holds for orthogonal movement, perpendicular the main axis 18 of the cylinder 12, a block 36. The block 36 is orthogonally adjustable relative to the axis 18 by an appropriate mechanism, such as the micrometer-type of adjusters 38 and 40 shown.

Fixed to the block 36 is a mount 42. One side of the mount 42 carries a first piston-cylinder 44. Removably carried by and protruding from the other side of the mount 42 is a second piston-cylinder 46, the cylinder of which carries a tube or nozzle 48 having a bore 49 terminating in an output orifice 50 proximate the cylinder 12. Referring to FIGS. 1 and 3–6, the tube 48 and its bore 49 are preferably angularly truncated so that the orifice 50 is, elliptical and the tube 48 has a tip 48*t* and a heel 48*h*. The major axis a of the orifice 50 lies between the tip 48*t* and the heel 48*h*, with the minor axis b being at a right angle thereto.

Figure 4:
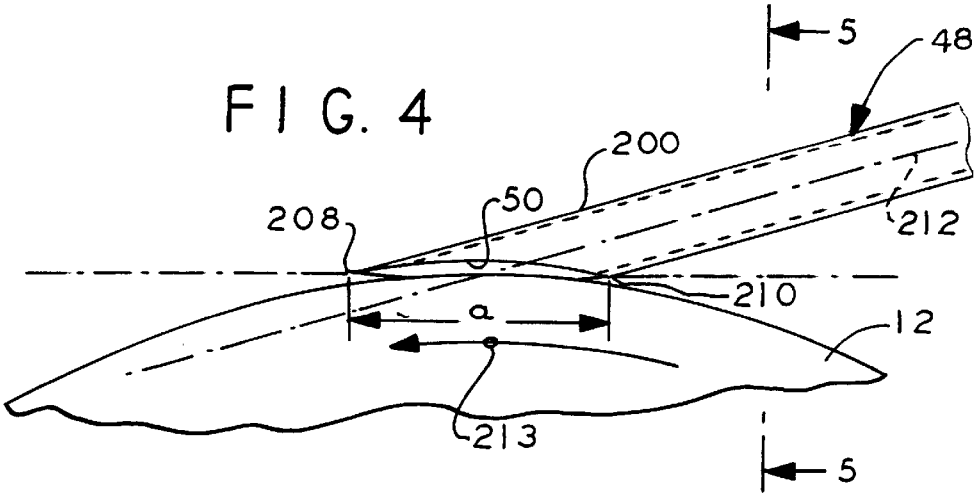
FIGS. 4, 5, 6, 7 and 8 depict magnified views of a portion of the system of FIGS. 1–3 illustrating the practice of the method of the present invention.
Figure 5:
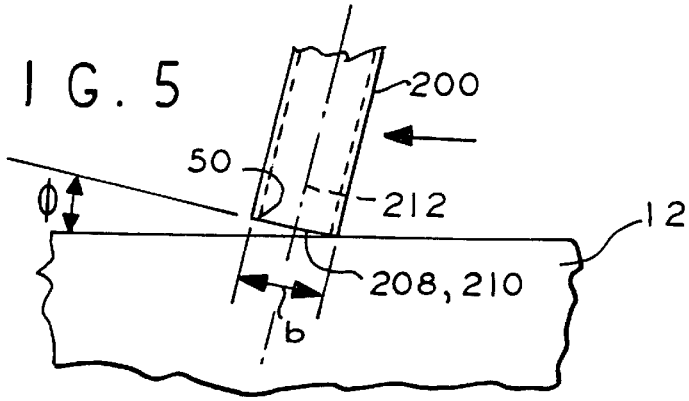
Figure 6:
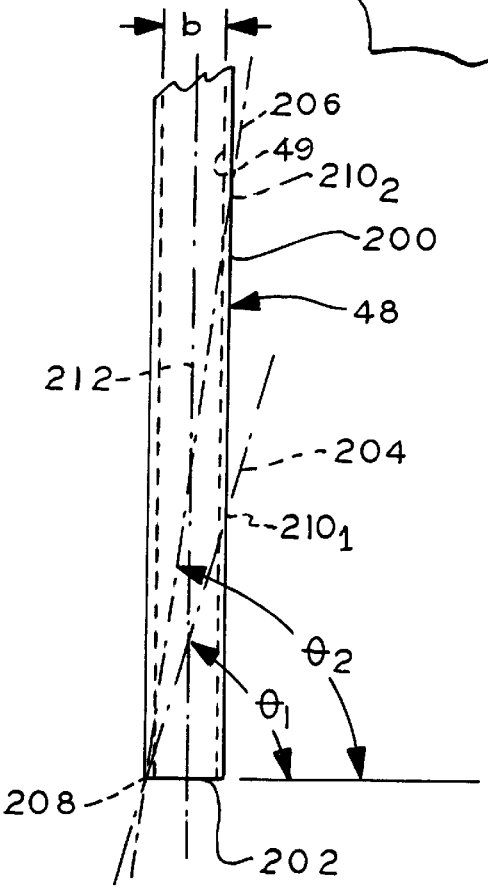

Referring to FIGS. 4–6, the tube 48, which may comprise a thin-walled nozzle or hypodermic-needle-like element, originally includes a right-circular cylinder body 200 defining the bore 49, which is also a right circular cylinder. A distal end 202 of the tube 48 and its bore 49 are cut, formed or machined so as to be angularly truncated along a plane, such as plane 204 or 206. This truncation causes the bore 49 to terminate in the elliptical orifice 50 and the tube 48 to concomitantly have a tip 208 and a opposed heel 210, both of which lie on a major axis a of the ellipse. A minor axis b of the ellipse is perpendicular to the major axis a and is equal to the diameter of the bore 49. The planes 204, 206 form an angle θ (theta) with the major axis 212 of the tube 48 (and the bore 49) and the wall of the bore 49. The plane 204 forms an angle $\theta_1$ (theta$_1$); the plane 206 forms an angle $\theta_2$ (theta$_2$). The sizes of the diameter of the bore 49 and the major and minor axes a and b are selected as described above.

The block 36, the adjusters 38 and 40, and the mount 42 are adjusted or configured so that the plane of the elliptical orifice 50 is generally tangent to the cylinder 12, except as noted below (FIG. 4). The orifice 50 is located so that the cylinder 12 rotates (arrow 213) from the heel 210 to the tip 208 and so that at least a portion of the periphery of the tube 48 at the orifice 50 engages the rotating cylinder 12. Preferably, the tube 48 is slightly tilted or canted (FIG. 5) so that its major axis 212 is slightly angled relative to the surface of the cylinder 12 by a small angle ϕ (phi). The piston-cylinder 44 and 46 may be selectively held in and removed from the mount 42 via the attachment and removal of a cover 52 on the mount 42.

The piston (not shown) of the first piston-cylinder 44 is leftwardly movable by applying pressurized hydraulic fluid to a line 54 communicating with the variable volume (not shown) to the right thereof. The piston is rightwardly movable by application of hydraulic fluid to a line 56 communicating with the variable volume to the left of the piston (not shown). The piston of the first piston-cylinder 44 is connected to the piston 58 of the second piston-cylinder device 46 by a rod 60. The variable volume 62 of the cylinder of the second piston-cylinder 46 may be filled with a measured quantity of a flowable, curable, self-levelling plastic composition which is engraveable or etchable once cured, as described above. The plastic composition is flowable through the bore 49 and the aperture 50 and, in the case of the compositions of the '595 or '693 Applications, has a preferred viscosity of from about 800 cP to about 5,000 cP, preferably from about 1,000 cP to about 2,000 cP. These compositions include a large number of self-levelling UV-curable, heat-curable and/or room temperature gelating plastic compositions, such as plastic compositions which include one or more epoxide resins (e.g., cycloaliphatic epoxides or amine-based epoxides), vinyl esters formed from an epoxy-novolac compound, bisphenol A epoxy resins modified with cresol novolac(s), cycloaliphatic or amine based epoxide resins, epoxy resins which are the reaction product of epichlorohydrin and bisphenol A, and mixtures of expanding polycyclic, monomers. To these compositions there may be added, as appropriate, flexibilizers, photoinitiators, surfactants, slip agents, modifiers, additional epoxy resins, catalysts. promoters and accelerators. The compositions, once cured, are engraveable or etchable to produce printing cells or elevated printing surfaces.

Once the cylinder of the second piston-cylinder 46 is filled with a selected plastic composition and is held in the mount 42 by the cover 52, pressurization of the line 54 forces the plastic composition through the bore 49 of the tube 48 and out of the orifice 50 onto the surface of the cylinder 12. Preferably, the tube 48 touches the surface of the cylinder 12 as described above.

Figure 7:
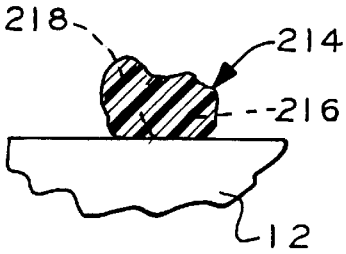

The tube 48 may be slightly tilted so as to deposit the plastic material upon the cylinder 12 in a wavelike form, following which the plastic material then self-levels immediately. That is, as shown in FIG. 7, with the tube 48 slightly tilted by the angle $\phi$ (phi) as in FIG. 5, the plastic material 214 forced from the orifice 50 may apppearing cross-section as a generally circular proximate strip or bead portion 216 and a distal lobate or nodular, wave-like portion 218. Immediately after being deposited on the cylinder 12, the material 214 begins to self-level.

Having the tube 48 contact the cylinder 12 has been found to obviate tube-cylinder 48-12 spacing problems. Specifically, attempts to produce a uniform coating with the tube 48 and its orifice 50 spaced from the cylinder 12 met with difficulty as non-circular rotation of the cylinder 12 led to varying spacings between the orifice 50 and the cylinder 12. These varying spacings affected the uniformity of the cured coating. With at least a portion of the tube 48 contacting and riding on the cylinder 12 at all times, the orifice 50 is maintained in at fixed spatial relationship relative thereof Any tendency of the proximity of the orifice 50 to the cylinder 12 (as where both termini of the minor axis b ride on the cylinder 12) to throttle or otherwise deleteriously affect the flow of the plastic composition from the orifice is, eliminated by the elliptical shape of the orifice 50 and the slight tipping of its plane by the angle $\phi$ (phi). Friction between the cylinder 12 and the tube 48 may cause tube 48 wear requiring replacement thereof, an inexpensive proposition at worst.

Preferably, a constant amount of plastic per unit time is delivered through the orifice 50 onto the surface of the cylinder 12. Preferably, the plastic is dispensed at a rate of from about 0.035 cc to about 0.155 cc per revolution of cylinder 12. The plastic is forced through the tube 48 and out of the orifice 50 onto cylinder 12 at a pressure of from about 8 psi to about 60 psi, preferably at about 30 psi.

The carriage 32 and the orifice 50 are linearly movable along the main cylinder axis 18 by a lead screw 64 to linearly or scan move the orifice 50 over and across the surface of the rotating drum 12 so as to lay up or deposit the composition as a helical strip or bead in a desired thickness in a single pass of the orifice 50 across the cylinder 12. In general, the orifice 50 travels along cylinder 12 at a rate of about ½" per minute, with the linear travel thereof per revolution of the cylinder 12 being as noted above.

As the plastic composition is being applied to the drum 12, the drum 12 is rotated at a rate of from about 30 rpm to about 90 rpm, preferably at about 45 rpm. Preferably, the drum 12 has a surface velocity of from about 5.0 inches per second to about 35.0 inches per second, more preferably from about 7.5 inches per second to about 16.0 inches per second. The lead screw 64, which may be selectively rotated by a drive gear 66 (FIG. 2) is rotatable held in opposed supports 68 (only one is shown) on the base 22. The lead screw 64 coacts with a traveler nut 70 of any conventional design. The traveler nut 70 herein comprises a pair of arms 72 held in a frame 74 for pivoting toward and away from each other. Each arm 72 contains a threaded concavity 76 at one end which engagingly mates with the threads of the lead screw 64. Rotation of a thumb screw 78 threaded through the other end of one arm 72 and bearing against the other end of the other arm 72 forces the concavities 76 against the lead screw 64, so that rotation of the lead screw 64 is translated into linear movement of the frame 74. Linear movement of the frame 74 effects linear movement of the carriage 32, as above described. Release of the traveler nut 70 from the lead screw 64 and linear positioning of the carriage 32 without lead screw 64 rotation may be achieved by turning the thumb screw 78 to disengage the end of the other arm 72.

The apparatus 10 may include facilities 80 for curing the plastic film on the cylinder 12 with heat, UV or other radiation.

Figure 2:
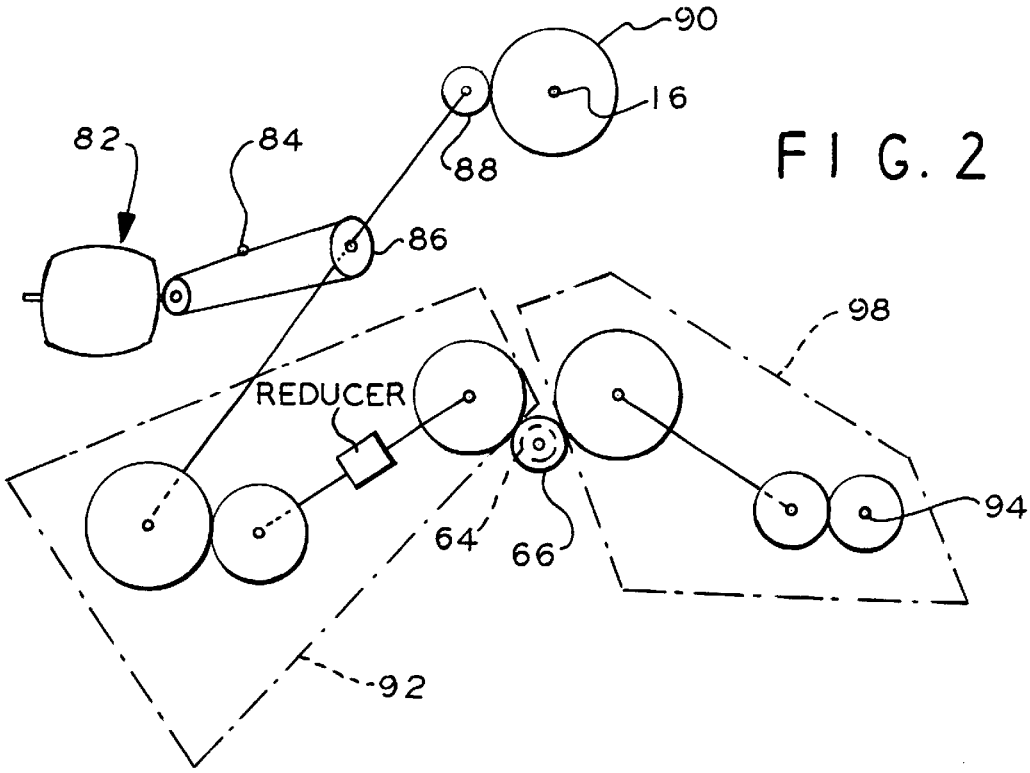
FIG. 2 is a schematic diagram of a motive power train usable to operate the apparatus of FIG. 1.

FIG. 2 schematically depicts one mode of simultaneously rotating the cylinder 12 and linearly moving the output aperture 50 while forcing plastic therefrom onto the rotating cylinder 12 by the action of the piston-cylinders 44 and 46. Clearly, numerous other arrangements may be used. A variable speed motor 82 drives a belt 84 to rotate a pulley 86. Rotation of the pulley 86 rotates a drive gear 88 to rotate a driven gear 90 and the drive shaft 16. The drive gear 66 for the lead screw 64 is similarly rotated by the motor 82 through a gear train/reducer combination 92. The drive gear 66 in turn operates a drive shaft 94 of a pump 96 (FIG. 3) for the piston-cylinder 44 through a gear train 98.

Figure 3:
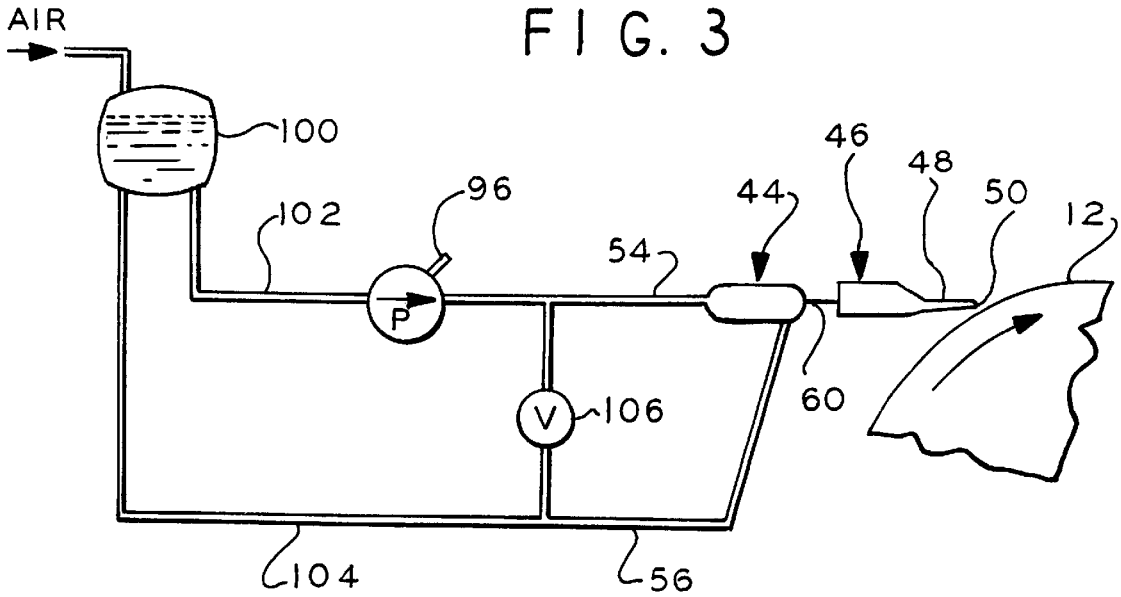
FIG. 3 is a schematic diagram of a hydraulic system for depositing a plastic film with the apparatus and power train of FIGS. 1 and 2.

In FIG. 3, the pump 96 pumps hydraulic fluid from a reservoir 100 via a line 102 and returns the fluid to the reservoir 100 via a line 104. A shunt valve 106 determines whether or not operation of the pump 96 effects a flow of the plastic composition from the output aperture 50. When the valve 106 is open, the pump moves the fluid from the reservoir 100 through the line 102 and the valve 106 back to the reservoir 100 through the line 104. When the valve 106 is closed, the fluid is forced by the pump 96 through the line 54, which is continuous with the line 106, into the variable volume to the right (in FIG. 1) of the piston of the piston-cylinder 44. As described above, this effects a flow of the plastic composition from the second piston-cylinder 46 onto the surface of the rotating cylinder 12 as the output aperture 50 is linearly moved or scanned across such surface parallel to the main axis 18. The plunger or piston 58 may be returned to the position of FIG. 1 after the cylinder 12 has been coated by stopping operation of the pump 96, opening the valve manually returning the piston 58 to the position shown in FIG. 1.

Figure 8:
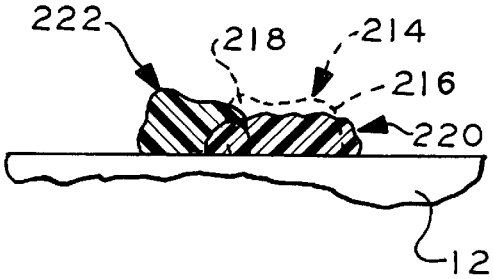

The rotational velocity of the drum 12 and the linear movement of the tube 48 are adjusted so that adjacent portions or runs of the bead or strip of the self-levelling, composition 214 on the cylinder 12 overlap and merge as they are deposited and self-level. As shown in FIG. 8, the material 214 which was deposited in FIG. 7 has self-levelled, as shown at 220, at the time depicted in FIG. 8. Material 222 deposited adjacent to the levelled material 220 overlaps the material 220, as shown, and itself self-levels and is; overlapped by the next adjacent run or portion of the bead or strip of the plastic composition. To produce the preferred 0.0035" thick composition film, tubes 48 having bores 49 with 0.010", 0.023" or 0.053" diameters (and ellipse minor axes b) were used and were moved across; the surface of the rotating cylinder 12 at respective rates of 0.008"–0.010" per revolution, 0.019"–0.021" per revolution, and 0.040"–0.048" per revolution. These dimensions also represent the approximate center-to-center spacing of the adjacent runs or portion of the strip or bead when tubes 48 with the illustrative bore sizes are used.

The above method is capable of effecting the deposit of a uniform, continuous and engraveable or etchable film onto the cylinder 12. The film has a thickness of from about 0.003" to about 0.005, preferably from about 0.0032" to about 0.0035". This is achieved by adjusting the speed of the motor 82; selecting the character of the drive train 84, 86, 88, 90, 92 and 98 and the pitch of the lead screw 64 and the traveler nut 70; adjusting the rotational velocity of the lead screw 64 and of the cylinder 12, the linear velocity of the carriage 32, the spacing between the output orifice 50 and the surface of the rotating cylinder 12, the size of the orifice 50, and the rate of movement of the plunger 58 in the piston-like device 46—all in view of the characteristics of the plastic composition chosen—to deposit the helical bead or strip of the plastic composition on the surface of the cylinder 12. As noted, adjacent portions or runs of the bead or strip when issuing from the orifice 50 are approximately the same as or are slightly larger in diameter than the center-to-center distance between adjacent portions of the helical "track" defined between the tube 48 (and its orifice 50) and the cylinder as the cylinder 12 rotates thereunder and the tube 48 moves along the cylinder 12. The foregoing produces a slight overlap of adjacent bead portions, which, along with the self-leveling properties of the plastic composition, contribute to the ultimate continuous film having a relatively uniform thickness.

It should be clear that numerous variations can be made to the above-disclosed embodiment without departing from the scope or intent of the present invention. The piston-cylinders 44 and 46 may be replaced by a constant volume or metering pump or by a precision gear pump, such as those marketed by Nichols-Zenith Div., Packer Hannifin Corp. to meter a given volume of plastic per unit time through the orifice 50. The motor-drive train of FIG. 2 may be replaced with individual motive power sources—stepping motors for instance—associated with the collet 14, the lead screw 64 and the pump 96 (or the metering pump, if such is used). Moreover, facilities, such as an automated electronic microscope slide adjuster, can replace the micrometer-like adjusters 38 and 40. Further, the cylinder 12 may be replaced by a flat or other non-cylindrical surface which is moved relatively to an orifice to deposit adjacent strips or beads of a self-levelling plastic composition.

If the plastic composition comprises mixed components, mixing may take place at or near the orifice 50 using known static-tube, mechanical or impingement techniques. Moreover, the adjacent strip or bead portions may be deposited from side-by-side or adjacent orifices simultaneously moved relative to the surface.

The curing facility 80 may reside in the apparatus 10 as shown, or the plastic-coated cylinder 12 may be removed from the collet 14 and placed in appropriate curing environment.

After the film has been applied to cylinder 12, the film may be prepared by engraving, or other techniques as hereinabove described so as to provide a suitable printing medium having cells or, as in the case of flexographic printing, raised or elevated ink-transferring surfaces.

Advantages of the present invention include the ability to provide a printing medium or image carrier upon a printing substrate such as a printing cylinder or printing roll—including non-metallic cylinder or rolls—without the use and/or disposal of environmentally hazardous chemicals during its preparation. The method of the present invention, whereby a plastic composition, as opposed to a metal, is applied to a printing substrate, thus provides for a more efficient and environmentally safe process for providing a rotogravure printing medium, which also saves the considerable costs associated with the formation and treatment of copper-etched surfaces.

It is to be understood, however, that the scope of the present invention is not to be limited to the specific embodiments described above. The invention may be practiced other than as particularly described and still be within the scope of the accompanying claims.

What is claimed is:

1. A method of making a rotogravure printing medium which includes a member coated with a film that is selectively removable to produce ink-retaining cells or ink-transferring surfaces, wherein the method comprises:

depositing on the member a series of adjacent strip or bead portions of a self-leveling, curable plastic composition which is engraveable or otherwise selectively removable after curing to produce ink-retaining cells, the adjacent strip or bead portions merging and self-leveling at and after deposition to produce a uniform, continuous coating of the plastic composition.

2. A method as in claim 1, wherein the printing medium is a roll, the member is a cylinder, and the adjacent strip or bead portions are portions of a continuous helical strip or bead of the plastic composition which is deposited on the surface of the cylinder.

3. A method as in claim 2, wherein:

a dimension of the cross-section the plastic composition strip or bead as it is deposited on the cylinder, such dimension being taken parallel to the cylinder, is substantially equal to or greater than the center-to-center distance between adjacent portions of the strip or bead as they are deposited on the cylinder.

4. A method as in claim 2, wherein:

depositing the plastic composition is effected by rotating the cylinder, and simultaneously flowing the plastic composition onto the cylinder from a site which travels across the cylinder parallel to its main axis.

5. A method as in claim 4, wherein:

the cross-section of the plastic composition strip or bead as it is deposited on the rotating cylinder comprises a generally circular portion, which is trailing relative to the direction of travel of the site, and a contiguous lobate, wave-like portion, which is leading relative to the direction of travel of the site.

6. A method as in claim 5, wherein:

a dimension of the cross-section which is parallel to the cylinder is substantially equal to or greater than the center-to-center distance between adjacent portions of the strip or bead as they are deposited on the cylinder.

7. A method as in claim 2, wherein:

depositing the plastic composition includes flowing the plastic composition onto the cylinder from an orifice, and simultaneously effecting relative movement between the orifice and the cylinder.

8. A method as in claim 7, wherein:

the orifice is ellipsoidal with its major axis lying generally perpendicular to the major axis of the cylinder.

9. A method as in claim 8, wherein:

the relative movement includes a first component which lies generally along the extent of the strip or bead, and the major axis of the orifice lies generally along the first component.

10. A method as in claim 9, wherein:

the relative movement includes a second component which is generally transverse to the extent of the strip or bead, and the minor axis of the orifice lies generally along the second component.

11. A method as in claim 10, wherein:

the plane of the orifice is tipped so that a first point thereon located at one terminus of the minor axis is trailing relative to the second component and engages the surface of the cylinder, and so that a second point thereon located at the other terminus of the minor axis is leading relative to the second component and is spaced from the surface of the cylinder.

12. A method as in claim 11 wherein:

the first component is due to rotation of the cylinder, and the second component is due to movement of the orifice along the surface of the cylinder generally parallel to the main axis thereof.

13. A method as in claim 7, wherein:

at least a portion of the orifice is in constant contact with the surface during relative orifice-member movement.

14. A method as in claim 13, wherein:

the surface-contacting portion of the orifice is a point on periphery thereof.

15. A method as in claim 14, wherein:

the plane of the orifice is tipped so that the contacting point trails non-contacting points on the orifice periphery as the orifice moves relatively to the surface.

16. A method as in claim 15, wherein:

the orifice is ellipsoidal.

17. A method as in claim 16, wherein:

the contacting point is on the minor axis of the orifice.

18. A method as in claim 1, wherein:

depositing the plastic composition includes flowing the plastic composition onto the member from an orifice, and simultaneously effecting relative movement between the orifice and the member.

19. A method as in claim 18, wherein:

the orifice is ellipsoidal with its major axis lying generally parallel to the strip or bead portions.

20. A method as in claim 19, wherein:

the relative movement includes a first component which lies generally along the extent of the strip or bead, and the major axis of the orifice lies generally along the first component.

21. A method as in claim 20, wherein:

the relative movement includes a second component which is generally transverse to the extent of the strip or bead, and the minor axis of the orifice lies generally along the second component.

22. A method as in claim 21, wherein:

the plane of the orifice is tipped so that a first point thereon located at one terminus of the minor axis, which first point is trailing relative to the second component, engages the surface of the member and a second point thereon located at the other terminus of the minor axis, which second point is leading relative to the second component, is spaced from the surface of the member.

23. A method as in claim 22, wherein:

the cross-section of the plastic composition strip or bead as it flows onto the member comprises a generally circular portion, which is trailing relative to the second component, and a continuous, lobate, wave-like portion, which is leading relative to the second component.

24. A method as in claim 23, wherein:

the plastic-composition strip or bead as it is deposited on the member has a cross-section with a dimension lying along the second component which is equal to or greater than the center-to-center distance between adjacent portions of the strip or bead as they are deposited on the member.

25. A method as in claim 20, wherein:

the relative movement includes a component which is generally transverse to the extent of the strip or bead, and the minor axis of the orifice lies generally along the second component.

26. A method as in claim 20, wherein:

the relative movement includes a component which lies generally along the extent of the strip or bead, the major axis of the orifice lies generally along the component, and the minor axis of the orifice lies generally transverse to the component.

27. A method as in claim 26, wherein:

the plane of the orifice is tipped so that a first point thereon located at one terminus of the minor axis is trailing relative to the component and engages the surface of the cylinder, and so that a second point thereon located at the other terminus of the minor axis is leading relative to the component and is spaced from the surface of the cylinder.

28. A method as in claim 27, wherein:

the cross-section of the strip or bead as it flows onto the cylinder comprises a generally circular portion, which is trailing relative to the component, and a continuous lobate, wave-like portion, which is leading relative to the component.

29. A method of making a roll printing medium which includes a cylindrical member coated with a film that is selectively removable to produce ink-retaining cells or ink-transferring surfaces, wherein the method comprises:

depositing on the surface of the member a series of adjacent strip or bead portions of a continuous helical strip or bead of plastic of a self-leveling, irreversibly curable plastic composition on the surface of the member and which is engravable or otherwise selectively removable after curing to produce ink-retaining cells, the depositing including rotating the member and simultaneously flowing the plastic composition onto the cylindrical member from a site which travels across the member parallel to its main axis, the cross-section of the plastic composition strip or bead as it is deposited on the rotating member comprising a generally circular portion, which is trailing relative to the direction of travel of the site, and a contiguous lobate, wave-like portion, which is leading relative to the direction of the site, the adjacent strip or bead portions merging and self-leveling at and after deposition to produce a uniform, continuous coating of the plastic composition.

30. A method of making a roll printing medium which includes a cylindrical member coated with a film that is selectively removable to produce ink-retaining cells or ink-transferring surfaces, wherein the method comprises:

depositing on the surface of the member a series of adjacent strip or bead portions of a continuous helical strip of a self-leveling, irreversibly curable plastic composition which is engravable or otherwise selectively removable after curing to produce ink-retaining cells, the adjacent strip or bead portions merging and self-leveling at and after deposition to produce a uniform, continuous coating of the plastic composition, the depositing including flowing the plastic composition onto the member from an orifice, and simultaneously effecting relative movement between the orifice and the cylinder, the orifice being ellipsoidal with its major axis lying generally perpendicular to the major axis of the cylindrical member.

31. A method of making a printing medium which includes a member coated with a film that is selectively removable to produce ink-retaining cells or ink-transferring surfaces, wherein the method comprises:

depositing on the member a series of adjacent strip or bead portions of a self-leveling, irreversibly curable plastic composition which is engravable or otherwise selectively removable after curing to produce ink-retaining cells, the adjacent strip or bead portions merging and self-leveling at and after deposition to produce a uniform, continuous coating of the plastic composition, the depositing including flowing the plastic composition onto the member surface from an ellipsoidal orifice with its major axis lying generally parallel to the strip or bead portions, and simultaneously effecting relative movement between the orifice and the cylinder.

32. A method of making a roll printing medium which includes a cylindrical member coated with a film that is selectively removable to produce ink-retaining cells or ink-transferring surfaces, wherein the method comprises:

depositing on the surface of the member a series of adjacent strip or bead portions of a continuous helical strip of a self-leveling, irreversibly curable plastic composition which is engravable or otherwise selectively removable after curing to produce ink-retaining cells, the adjacent strip or bead portions merging and self-leveling at and after deposition to produce a uniform, continuous coating of the plastic composition, the depositing including flowing the plastic composition onto the member surface from an orifice, and simultaneously effecting relative movement between the orifice and the cylinder, at least a portion of the orifice being in constant contact with the surface of the member during the relative orifice-member movement.

33. A method of making a printing medium which includes a member coated with a film that is selectively removable to produce ink-retaining cells or ink-transferring surfaces, wherein the method comprises:

depositing on the member a series of adjacent strip or bead portions of a self-leveling, irreversibly curable plastic composition which is engravable or otherwise selectively removable after curing to produce ink-retaining cells, the adjacent strip or bead portions merging and self-leveling at and after deposition to produce a uniform, continuous coating of the plastic composition; and curing said plastic composition and then forming said ink-retaining cells in said cured uniform continuous coating of the plastic composition.

* * * * *